United States Patent [19]

Andrews

[11] Patent Number: 5,051,165

[45] Date of Patent: Sep. 24, 1991

[54] QUALITY OF HEAVY MINERAL CONCENTRATES

[75] Inventor: William H. Andrews, Waverley, Australia

[73] Assignee: Wimmera Industrial Minerals Pty. Ltd., Victoria, Australia

[21] Appl. No.: 451,209

[22] Filed: Dec. 15, 1989

[30] Foreign Application Priority Data

Dec. 19, 1988 [AU] Australia ..... PJ2018

[51] Int. Cl.[5] ..... B03D 1/02

[52] U.S. Cl. ..... 209/166; 209/167; 423/3

[58] Field of Search ..... 209/166, 167; 252/61; 423/3

[56] References Cited

U.S. PATENT DOCUMENTS

| | | | |
|---|---|---|---|
| 2,000,656 | 5/1935 | Armstrong | 209/166 |
| 2,570,119 | 10/1951 | Handley | 209/166 |
| 2,570,120 | 10/1951 | Handley | 209/166 |
| 2,610,738 | 9/1952 | Cuthbertson | 209/167 |
| 2,697,518 | 12/1954 | Bennett | 209/166 |
| 2.861,687 | 11/1958 | Lord | 209/167 |
| 3,138,550 | 6/1964 | Woolery | 209/166 |
| 3,589,622 | 6/1971 | Weston | 209/166 |
| 3,647,629 | 8/1953 | Veltman | 209/166 |

FOREIGN PATENT DOCUMENTS

| | | | |
|---|---|---|---|
| 167911 | 11/1954 | Australia | 209/166 |
| 228907 | 2/1959 | Australia | 209/166 |
| 4953 | 10/1979 | European Pat. Off. | 209/166 |
| 2731824 | 1/1978 | Fed. Rep. of Germany | 209/167 |

OTHER PUBLICATIONS

"Radiation Doses in the Sand Mining Industry", by Hartley et al from Australian Conference on Minerals, Sep.-Oct. 1986.

"The Development of Occupational Health and Safety Policy and Practices", by Watson from Australian Conference on Minerals, Sep.-Oct. 1986.

"Benefication of Uranium Ores", by Tame & Rosenbaum, Report #5884, U.S. Dept. of the Interior, pp. 1-28.

"The Separation of Monazite from Zircon by Flotation", by Abeidu, Journal of Less-Common Metals, vol. 289, 1979.

*Primary Examiner*—Stanley S. Silverman
*Assistant Examiner*—Thomas M. Lithgow
*Attorney, Agent, or Firm*—Price, Heneveld, Cooper, DeWitt & Litton

[57] ABSTRACT

The specification discloses a process for substantially reducing the radioactivity of heavy mineral concentrates or mineral mixtures. The process comprises the removal of radioactive minerals present in the heavy mineral concentrate or mixture by a selective flotation procedure. The process yields a single flotation fraction containing the radioactive minerals.

3 Claims, No Drawings

QUALITY OF HEAVY MINERAL CONCENTRATES

BACKGROUND OF THE INVENTION

This invention relates to a process for improving the quality of heavy mineral concentrates, more particularly for the removal of and/or recovery of radioactive contaminants in such concentrates.

Bulk concentrates are usually further processed to produce individual mineral concentrates, and the presence of radioactive particles in those individual mineral concentrates may cause problems in the handling thereof. In one aspect the present invention addresses this problem by providing a process in which the bulk concentrate is subjected to flotation step to separate certain components before it is further processed to produce individual mineral concentrates. Further advantages of the process of the invention will be apparent from the following disclosure.

It will be understood that concentrations of detrital heavy minerals result from normal cycles of erosion of the land surface and economic deposits occur where the rock material has yielded sufficient quantities of the valuable mineral types and where physiography and climate have provided suitable conditions of transport and accumulation.

Deposits of heavy minerals occur widely throughout the world, with Australia, Malaysia, New Zealand, Africa, Madagascar and USA being well-known for such concentrations. The usual concentrating mechanisms are water and wind. Such deposits are now the common source of titanium minerals, primarily used for the production of the white pigment, titanium dioxide, and of zircon, a material used in ceramics and refractories.

The term "heavy mineral" has come to be associated with the higher density phases present in such deposits and is therefore used herein to refer to those minerals which have a density greater than 2.96, the density of tetrabromoethane (TBE) the liquid normally used in a sink-float operation to give preliminary estimates of valuable mineral content. A number of minerals such as tourmaline have densities between 2.96 and 3.3 and these can be quantified as "light heavy minerals" by further separation with methylene iodide at a density of 3.3.

Minerals which survive the erosive and corrosive environments commonly involved are ilmenite, rutile, zircon, monazite, xenotime, cassiterite, gold, minerals of the platinoid group, gemstones, garnet, sillimanite and tourmaline. A variety of other minerals are often associated with such deposits, e.g. leucoxene which results from the progressive oxidation and leaching of the iron present in the mineral ilmenite. Because of the progressive nature of these chemical changes, the mineralogy and chemistry of leucoxene grains vary very widely.

The common method of recovery of such minerals is by wet or dry mining, most commonly by wet dredging, followed by wet processing to recover the valuable minerals as a bulk concentrate while rejecting the bulk of minerals of no economic importance, such as quartz, as quickly as possible. The ability to achieve this objective quickly and cheaply becomes important when it is recognised that deposits containing as little as 1% valuable heavy minerals are currently treated. This wet separation usually is based on gravity methods, and use may be made of spirals, shaking tables or cone separators.

The bulk concentrate, after retreatment, if appropriate, to reduce the amount of quartz contained, is normally further processed through a relatively complicated set of unit operations to produce saleable grades of individual mineral concentrates. Commonly the first stage involves recovery of the ilmenite mineral by wet or dry magnetic separation. The concentrates generated normally require cleaning to improve the grade by rejection of other minerals entrained during the magnetic separation. Following this separation, the non-magnetic fraction must be dried, if this operation was not performed prior to magnetic separation, and then subjected to a further range of separations based on the use of electrostatic and magnetic principles. Essentially the separation of the less magnetic minerals rely upon the initial use of electrostatic separation to separate the conductors, particularly rutile and leucoxene, from the non-conducting minerals, such as zircon and monazite. The various streams resulting from the electrostatic separation then pass to units where both wet and dry separations using magnetic, gravity and/or further electrostatic separations are practised to achieve the final grades required.

A major problem encountered in such complex circuitry is the difficulty of achieving high recoveries of the minerals monazite and xenotime which are frequently present in such deposits. Both these minerals are rare earth phosphates, and apart from their economic value, they normally contain variable amounts of the radioactive elements uranium and thorium which are undesirable environmentally and in other ways. Monazite may contain up to 12% $ThO_2$ while a typical xenotime has been reported to carry 1.85% $ThO_2$ and 0.32% $U_3O_8$.

Monazite and xenotime are characterised by high densities and are normally recovered, together with other heavy minerals, in the initial preconcentration circuit. However, because of the generally low levels of each and the variability of composition, subsequent separation steps involving passage through numerous items of equipment often result in incomplete recovery in final monazite or xenotime concentrates (if indeed such concentration is attempted) and the minerals disperse unevenly throughout the major concentrates, with a particular tendency to report to zircon rich fractions. However, sufficient of the radioactive particles may report to the rutile and leucoxene concentrates to cause concern to receivers responsible for down stream processing and transport and to Government authorities.

Certain of the procedures used in the production of titanium dioxide from titanium mineral concentrates, and particularly those involving the formation of the intermediate compound titanium tetrachloride, result in the further concentration of the trace amounts of radioactive elements present in such concentrates. Concern exists regarding the handling of products and equipment contaminated with radioactive materials and it is understood that U.S. Government Agencies are imposing stringent specifications on the permissible levels of radioactivity in titanium concentrates.

The environmental situation is aggravated by the preferential degradation of the rare earth phosphate minerals by attrition during wet and dry milling, as they are generally the least resistant minerals present with the potential for dust particles containing uranium and thorium to become airborne during dry separation operations. For this reason, greater emphasis is being placed on monitoring the work environments to ensure adequate levels of industrial hygiene are observed, since inhalation of radioactive dusts represents an occupational health hazard. Dust control is often necessary, requiring the installation of hooding and proper ventilation to remove the radioactive dust at the point of generation. Effective installation of equipment to achieve this is expensive and complicated by the large number of small capacity machines normally found in dry milling sections of heavy mineral separation plants.

Up to the present time, flotation has not been a favoured beneficiation procedure within the industry, however the invention herein disclosed proposes just such a procedure.

While this technique is more suitable to finer grained deposits than to the coarser beach or dune sand deposits normally treated, it can also be applied to the latter. Some limited use of flotation has been made in heavy mineral separation, including the "hot soap" flotation of zircon at Byron Bay, NSW before the introduction of electrostatic separation devices.

This invention proposes a novel approach to the problems associated with the presence in heavy mineral ore bodies of monazite and/or xenotime as accessory minerals. The economic importance of these minerals is generally minor in the context of heavy mineral production, the more important factors now being the strong need to eliminate adverse health risks associated with the presence of fine radioactive dust particles generated during milling and likely to be released into the atmosphere during dry milling and also to minimize the radioactivating level of individual mineral concentrates. The procedures described herein not only substantially eliminate such industrial hygiene risks, but can be important economically in enabling better recover of high grade concentrates of these minerals.

It was pointed out above that the complexity of the usual processing circuits and the multitude of individual items of equipment, coupled with the generally low content of the radioactive rare-earth phosphate minerals, caused an uneven distribution of such minerals throughout the final products. Consideration of such circuits has led us to the recognition of two important criteria which in current operations are not observed.

1. The operating stages should be carried out in slurry form as far as possible to minimise or eliminate dust concentration.
2. Recovery of monazite and zenotime should take place as early as possible.

SUMMARY OF THE INVENTION

Accordingly the present invention provides a process for substantially reducing the radioactivity of a heavy mineral concentrate or mineral mixture prior to further processing which process comprises removing radioactive minerals present therein by a selective flotation procedure resulting in a single flotation fraction or product containing the radioactive minerals.

Selective flotation is a procedure in which the flotation conditions are set so that one or more selected minerals float and the rest do not. Fatty acids are frequently used as flotation agents for the purpose of rendering hydrophobic the minerals required to be floated. Fatty acids such as Acintol FA2 are particularly useful for selectively floating phosphate minerals if the pH is in excess of 9. However, those skilled in the art will appreciate that no flotation will occur if the pH is too high. A pH of about 10 is ideal The fatty acid used can be derived from vegetable oils or animal fats. The chain length, degree of branching and degree of saturation of the fatty acid can all be important considerations depending on the minerals to be floated. Most fatty acids used in this application are in fact mixtures of a variety of fatty acids depending on their original source.

The quality of the froth produced by the collector in the flotation cell may be controlled by kerosene, distillate or the like.

DESCRIPTION OF THE PREFERRED EMBODIMENTS

The following examples show that the above two criteria can in fact be met by appropriate flotation technology applied to bulk heavy mineral concentrate normally produced in the first stage of concentration. This clearly reverses the normal approach within the industry whereby recovery of xenotime and monazite is among the final stages of treatment, usually from zircon-rich process streams. Treatment of a multitude of concentrate products, particularly zircon concentrates is thus reduced to one treatment of the bulk concentrate.

From the example, given below it will be apparent that by using a carefully selected flotation procedure, it is possible to establish a different and novel regime for the treatment of bulk heavy mineral concentrates in which removal of monazite and/or zenotime immediately after production of the bulk concentrate will result in the following very significant advantages:

1. Segregation of the two radioactive minerals into a single concentrate thus minimising distribution or dispersion into numerous process streams and products;
2. Minimisation of industrial hygiene hazards during any subsequent dry milling operations which would be necessary to produce specific individual mineral concentrates;
3. Increased recovery of the two minerals and thus potential for improving economic returns from processing of a deposit. The production of a mixed concentrate of these two minerals can obviously be used as an advantageous starting point for separation into individual concentrates taking advantage of known different characteristics such as magnetic susceptibilities.
4. Positive removal of radioactive minerals which may otherwise report partly titanium mineral concentrates and cause marketing difficulties, and even rejection of such concentrates because of inability to meet government or industry standards imposed to maintain acceptable standards of industrial hygiene during subsequent processing.

EXAMPLE 1

A 1 kilo sample of bulk fine grained heavy mineral concentrate containing approximately 40% by weight of minerals denser than SG 2.96 was used. This material has been produced in a semi-continuous pilot flotation plant using phosphonic acid derivatives as the flotation collector. The heavy minerals present were rutile, anatase, ilmenite, leucoxene, zircon, monazite and xenotime with "light heavies" such as tourmaline and andalusite also present and quartz as the major gangue mineral. The monazite content expressed as % Ce was about 0.3% (approximately 1.4% monazite) while the xenotime content expressed as % Y was about 0.15% (approximately 0.3% xenotime).

The conditions used in this example to float the monazite and zenotime were:

| | |
|---|---|
| Sodium silicate | 500 g/t |
| pH (caustic soda) | 10 |
| Conditioning time | 10 minutes |
| Acintol FA2 (Collector) | 500 g/t |
| Conditioning time | 5 minutes |
| Flotation time | 8 minutes |
| Cleaner flotation time | 4 minutes |

Rougher flotation was carried out in a 2.2 liter Denver laboratory flotation cell.

The rougher concentrate was refloated once in a 1.1 liter cell with no further reagent additions to clean the product.

The concentrate produced amounted to 1.79% by weight of the total carrying 97.9% of the monazite (at a cerium grade of 17.6%) and apparently 66.7% of the xenotime (at an yttrium grade of 5.7%). The total monazite and xenotime content of said concentrate exceeds 90%. The result was confirmed by QEMSEM (Quantitative Evaluation of Materials by Scanning Electron Microscopy) analysis of another concentrate sample produced by similar means. Effectively this means a reduction in the content of these radioactive minerals in the bulk concentrate of the order of 90%.

The discrepancy between recoveries of monazite and xenotime are due to the fact that in this ore about 30% of the element yttrium is associated with zircon. The two minerals have an isostructural relationship and substitution of yttrium phosphate into the zircon lattice is known to occur. In addition, inclusions of xenotime in zircon grains have been noted.

EXAMPLE 2

The heavy mineral concentrate used for Example 1 was relatively fine-grained, having a particle size typically finer than 63 micrometers.

A different concentrate typical of the product from the West Coast deposits of Australia was used for Example 2. This material was characterised by a particle sizing in the 300/75 micrometer range and represented a gravity concentrate from which the ilmenite fraction had been removed by wet high intensity magnetic separation. As such it was considered representative of the normal mineral suite fed to a dry mill, the major minerals present being zircon, rutile, leucoxene, quartz and a minor amount of monazite (1-1.5%). Light heavies such as staurolite and kyanite were also present.

The minerals were found to have a coating of fine slimes and high density attritioning followed by decantation of a slime fraction was essential.

The following typifies the conditions used and results obtained for this ore:

| | | |
|---|---|---|
| Attritioning: | Mass of solids | 1 kg |
| | Pulp density | 70% |
| | Sodium Silicate | 500 g/t |
| | Time | 10 minutes |
| Desliming: | Two stages. Slurry diluted to 4.5 liters, stirred and decanted immediately solids have settled. | |
| Conditioning: | Pulp density | 66% |
| | Sodium silicate | 250 g/t |
| | pH | 10 |
| | Time | 10 minutes |
| | Collector ACINTOL FA2 | 400 g/t |
| | Kerosene | 400 g/t |
| | Time | 7 minutes |
| Flotation: | Time | 17 minutes |

Flotation was carried out in a 1.2 liter cell. No cleaner stage was used.

The concentrate from this test amounted to 1.8% by weight of the original feed and reported on a total rear earth metal grade of 50.47% for an overall recovery of 80%.

It will be apparent to those versed in the art that other flotation regimes may be substituted for that described in the examples, but this is incidental to the principal objective of the invention, namely to overcome the potentially severe problems of an environmental and industrial hygiene nature associated with the presence of radioactive rare earth minerals in heavy mineral deposits, while maximising the recovery of these valuable accessory minerals and facilitating the production of high grade concentrates of zircon and titanium minerals in subsequent processing.

It will be clearly understood that the invention in its general aspects is not limited to the specific details referred to hereinabove.

I claim:

1. A process for decreasing environmental hazards associated with processing a heavy mineral ore or concentrate containing a radioactive mineral which process comprises conditioning the heavy mineral ore or concentrate with sodium silicate, subjecting the heavy mineral ore or concentrate to a selective flotation procedure to form a single flotation fraction comprising the radioactive mineral and a tailing fraction comprising a heavy mineral ore or concentrate exhibiting reduced radioactivity; subjecting the tailing fraction to further processing steps to recover saleable heavy mineral products; and removing the flotation fraction for disposal or further processing to recover the radioactive mineral, the selective flotation procedure comprising flotation in the presence of a collector for said radioactive mineral comprising a fatty acid.

2. A process according to claim 1 wherein the radioactive mineral is monazite, zenotime or both.

3. A process according to claim 1 wherein the selective flotation procedure is performed at a pH in the range from 9 to 10.

* * * * *